US012287113B2

(12) United States Patent
Haraguchi

(10) Patent No.: US 12,287,113 B2
(45) Date of Patent: Apr. 29, 2025

(54) BUILDING, BUILDING METHOD, INSTALLATION METHOD, DEVICE CONTROL SYSTEM AND AIR-CONDITIONING DEVICE

(71) Applicant: NICHIA CORPORATION, Anan (JP)

(72) Inventor: Kei Haraguchi, Itano-gun (JP)

(73) Assignee: NICHIA CORPORATION, Anan (JP)

( * ) Notice: Subject to any disclaimer, the term of this patent is extended or adjusted under 35 U.S.C. 154(b) by 657 days.

(21) Appl. No.: 17/414,866

(22) PCT Filed: Dec. 13, 2019

(86) PCT No.: PCT/JP2019/048868
§ 371 (c)(1),
(2) Date: Jun. 16, 2021

(87) PCT Pub. No.: WO2020/129828
PCT Pub. Date: Jun. 25, 2020

(65) Prior Publication Data

US 2022/0057101 A1 Feb. 24, 2022

(30) Foreign Application Priority Data

Dec. 17, 2018 (JP) ..... 2018-235516

(51) Int. Cl.
*E04B 9/00* (2006.01)
*F24F 1/0047* (2019.01)
(Continued)

(52) U.S. Cl.
CPC ..... *F24F 13/078* (2013.01); *E04B 9/006* (2013.01); *F24F 1/0047* (2019.02); *F24F 11/65* (2018.01)

(58) Field of Classification Search
CPC ..... F24F 13/078; F24F 11/65; F24F 1/0047; F24F 3/056; F24F 2221/02; F24F 2130/30; E04B 9/006
(Continued)

(56) References Cited

U.S. PATENT DOCUMENTS

2015/0153062 A1* 6/2015 Kim ..... H05B 47/19 607/90
2020/0103125 A1* 4/2020 Hwang ..... F24F 1/0038

FOREIGN PATENT DOCUMENTS

JP H04-000897 A 1/1992
JP H05-083926 U 11/1993
(Continued)

OTHER PUBLICATIONS

Nagao, Osamu, JPH11273447 Translation.pdf, "Ceiling luminaire integrated with air conditioner", Oct. 1999, pp. 1-4.*
(Continued)

*Primary Examiner* — Avinash A Savani
*Assistant Examiner* — Ryan L Faulkner
(74) *Attorney, Agent, or Firm* — Foley & Lardner LLP

(57) ABSTRACT

Object:
A building that enables lighting and air-conditioning to be effectively linked with each other is configured.
Resolution means:
An air-conditioning device including a connector receiving portion is installed on a ceiling, and the air-conditioning device and a plurality of lighting fixtures disposed around the air-conditioning device are electrically connected to each other with wirings provided for the number of the plurality of lighting fixtures installed around the air-conditioning device. Further, the air-conditioning device supplies power converted into a power voltage for the lighting fixtures to the plurality of electrically connected lighting fixtures. A wiring
(Continued)

that passes through the rear of the ceiling is taken out of an opening of a ceiling member, and is connected to the lighting fixtures, so that the lighting fixtures are installed on the ceiling. An operation unit is operated to collectively control the air-conditioning device and the plurality of lighting fixtures disposed around the air-conditioning device.

10 Claims, 8 Drawing Sheets

(51) Int. Cl.
*F24F 11/65* (2018.01)
*F24F 13/078* (2006.01)

(58) Field of Classification Search
USPC ..... 454/248
See application file for complete search history.

(56) References Cited

FOREIGN PATENT DOCUMENTS

| | | | | |
|---|---|---|---|---|
| JP | H06-217440 | A | | 8/1994 |
| JP | 11273447 | A | * | 10/1999 |
| JP | H11-273447 | A | | 10/1999 |
| JP | 2000-074457 | A | | 3/2000 |
| JP | 2005-037117 | A | | 2/2005 |
| JP | 2006-070561 | A | | 3/2006 |
| JP | 2010-243112 | A | | 10/2010 |
| JP | 2012-069340 | A | | 4/2012 |
| JP | 5026311 | B2 | | 9/2012 |
| JP | 2013-134956 | A | | 7/2013 |
| JP | 2013-142518 | A | | 7/2013 |
| JP | 2014-103100 | A | | 6/2014 |
| JP | 2015-022932 | A | | 2/2015 |
| JP | 2017-098116 | A | | 6/2017 |
| JP | 6388742 | B1 | | 9/2018 |
| KR | 10-20170064531 | | * | 5/2017 |

OTHER PUBLICATIONS

Ishida, Koichi, JP2005037117 Translation.pdf, "Indoor machine for air conditioner", Feb. 2005, pp. 1-33.*

Nagao, Osamu, JPH11273447 Translation.pdf, "Ceiling luminaire intergrated with air conditioner", Oct. 1999, pp. 1-4.*

Morikawa, Tsutomu, JPH04897 Translation.pdf, "Transmitter holding device for facility equipment controller", Jan. 1992, pp. 1-3.*

* cited by examiner

BUILDING, BUILDING METHOD, INSTALLATION METHOD, DEVICE CONTROL SYSTEM AND AIR-CONDITIONING DEVICE

CROSS REFERENCE TO RELATED APPLICATIONS

This is a National Stage Application of PCT Application No. PCT/JP2019/048868, filed on Dec. 13, 2019, which claims priority to Japanese Patent Application No. 2018-235516 filed on Dec. 17, 2018.

TECHNICAL FIELD

The present invention relates to a building, a method of constructing a building, a method of installing a lighting fixture and an air-conditioning device, a device control system, and an air-conditioning device.

BACKGROUND ART

In an office building, a factory, a commercial facility, or almost all the buildings not limited to these, lighting and air-conditioning are essential elements. Further, in a case in which a building is constructed, the work proceeds through the procedure in order of foundation work, structural construction, finishing work, and facility construction.

Electrical equipment such as lighting and air-conditioning is installed after the structural body is completed. Patent Document 1 discloses a support device for a ceiling-mounted device that enables prompt and easy performance of work to attach a ceiling-mounted device such as lighting to the ceiling. Further, Patent Document 2 discloses a construction method that allows for efficiently performing construction work of an air-conditioning device of a ceiling-installed type.

CITATION LIST

Patent Literature

Patent Document 1: JP 2006-70561 A
Patent Document 2: JP 6388742 B

SUMMARY OF INVENTION

Technical Problem

However, a system for efficiently linking lightings and air conditioners together in construction of a building or an installation method therefor has not yet been sufficiently studied.

Solution to Problem

A building according to one embodiment of the present invention is constructed with a method including: providing a first wiring for supply of power to an air-conditioning device in a rear of a ceiling; forming a ceiling by fixing a plurality of ceiling members with a hanging member; providing the air-conditioning device including a connector receiving portion for the supply of power to a lighting fixture and configured to receive the supply of power from the first wiring and supply a power voltage converted with a converter to the lighting fixture; providing a plurality of the lighting fixtures configured to receive the supply of power from the air-conditioning device; providing second wirings for the number of the plurality of the lighting fixtures configured to receive the supply of power from the air-conditioning device, the second wirings each including a first connector configured to receive the supply of power from the air-conditioning device at one end and a second connector configured to be connected to the lighting fixture at another end; connecting the first wiring and the air-conditioning device to each other through an opening for the air-conditioning device provided in the plurality of ceiling members, the first wiring being disposed in a ceiling rear space present above the ceiling that is formed, the air-conditioning device being provided in a room space present below the ceiling that is formed; connecting the connector receiving portion provided in the air-conditioning device and the first connector of the second wirings; fixing the air-conditioning device with the hanging member; installing, on the ceiling, the air-conditioning device connected to the second wirings at the connector receiving portion and fixed with the hanging member; and connecting the plurality of the lighting fixtures configured to receive the supply of power from the air-conditioning device and the second wirings provided for the number of the plurality of the lighting fixtures configured to receive the supply of power from the air-conditioning device by passing the second wirings through the ceiling rear space.

In a building according to one embodiment of the present invention, an air-conditioning device and a lighting fixture are installed with a method including: connecting a first wiring disposed in a ceiling rear space for supply of power to the air-conditioning device to the air-conditioning device including a connector receiving portion for the supply of power to the lighting fixture and configured to receive the supply of power from the first wiring and supply a power voltage converted with a converter to the lighting fixture; connecting the connector receiving portion provided in the air-conditioning device and a first connector of second wirings, the second wirings each including the first connector configured to receive the supply of power from the air-conditioning device at one end and a second connector configured to be connected to the lighting fixture at another end; fixing the air-conditioning device with a hanging member; installing, on the ceiling, the air-conditioning device connected to the second wirings at the connector receiving portion and fixed with the hanging member; and connecting a plurality of the lighting fixtures configured to receive the supply of power from the air-conditioning device and the second wirings provided for the number of the plurality of the lighting fixtures configured to receive the supply of power from the air-conditioning device by passing the second wirings through the ceiling rear space.

A device control system according to one embodiment of the present invention is a system including: a plurality of the air-conditioning devices to be installed on a ceiling; a plurality of the lighting fixtures whose number is greater than the number of the plurality of the air-conditioning devices to be installed on the ceiling; and an operation unit configured to allow a user to perform operation for the air-conditioning device and the lighting fixture, wherein the air-conditioning device includes a connector receiving portion configured to supply a power voltage to the lighting fixture, a plurality of the lighting fixtures to be installed near the air-conditioning device are electrically connected to a wiring connected to the connector receiving portion of the air-conditioning device and receive the supply of the power voltage from the air-conditioning device, and the operation unit configures a system configured to provide a user with operation to collectively perform an instruction for the air-conditioning device and the plurality of the lighting fixtures configured to receive the supply of the power voltage from the air-conditioning device, and controls an air-conditioning device and a lighting fixture that are installed in a room space of a building.

A device control system according to one embodiment of the present invention includes: a plurality of the air-conditioning devices to be installed on a ceiling; and a plurality of the lighting fixtures to be installed around each of the plurality of the air-conditioning devices to be installed on the ceiling, wherein each of the plurality of the air-conditioning devices includes a connector receiving portion configured to supply a power voltage to the lighting fixture and a control unit configured to control the supply of the power voltage to four or more of the lighting fixtures each electrically connected to a wiring connected to the connector receiving portion of the air-conditioning device itself and installed near the air-conditioning device itself on the ceiling, and the device control system controls an air-conditioning device and a lighting fixture that are installed in a room space of a building.

An air-conditioning device according to one embodiment of the present invention includes: a casing including an upper surface and a plurality of lateral surfaces; a ceiling surface panel including a lower surface forming a ceiling surface and an upper surface connected to the casing; an air-conditioning unit; a control unit including an air-conditioning operation control unit and a lighting power control unit, the air-conditioning operation control unit being configured to control supply of a power voltage for causing the air-conditioning unit to operate, the lighting power control unit being configured to control supply of power to a lighting fixture; and four or more connector receiving portions provided on the plurality of lateral surfaces of the casing.

Advantageous Effects of Invention

According to the present invention, a building that enables lighting and air-conditioning to be effectively linked with each other can be configured.

DESCRIPTION OF EMBODIMENTS

Figure 1:
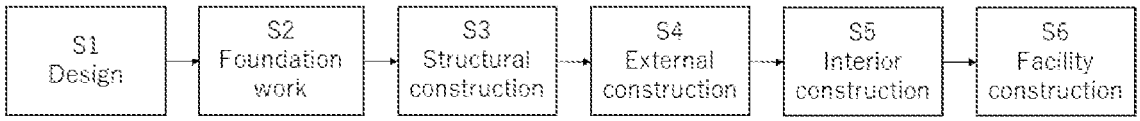
FIG. 1 is a flowchart for describing the flow of lighting installation in steps until a building is constructed.

Certain embodiments of the present invention are described below with reference to the drawings. The embodiments to be described below are given for embodying the technical idea of the present invention, and are not intended to limit the present invention. Further, in the following description, members having the same terms and reference signs represent the same members or members of the same quality, and the detailed description thereof will be omitted as appropriate. Note that, size, positional relationship, or the like of members illustrated in the drawings can be exaggerated for clarity of description.

FIG. 1 is a flowchart for describing a flow of steps until a building is constructed. In the example herein, a case of buildings having a multi-floor structure and having corridors and rooms, such as a general office building will be described. In the construction of large scale buildings such as office buildings, a general constructor undertakes the order of constructive work and arranges all of the construction works performed by various kinds of contractors.

First, a design architect or designer designs the building (step S1). In this step, the layout of the corridors, the rooms, and the like are decided, and the overall design of the building is depicted in a design drawing. The building materials to be employed, the electrical equipment members such as lighting fixtures and air-conditioning devices are also determined to a certain degree, and the arrangement thereof is also depicted in the drawings.

Next, on the basis of the determined design, building materials and construction machinery are provided, and the foundation work is performed (step S2). In this step, a stable foundation that can withstand the load of the building is ensured by way of pile construction or earth construction. Such a work is mainly performed by workers of contractors performing civil engineering. Note that the workers are not limited to workers of civil engineering contractors, but workers of other contractors work as well.

Next, structural construction is performed, in which a structural body of the building is formed on the stable foundation (step S3). In a case in which the building includes a base part or a basement floor, the structural construction begins with subterranean construction, such as construction of the basement floor, and advances to the ground floor. Concrete casting, positioning of piles, steel frame assembly, and the like are performed to complete the overall framework of the building. Concrete is also poured onto the outer walls, roof, floor of each story, and the like.

During the structural construction, an insert is embedded in order to hang hanging members such as hanging bolts used in the subsequent interior construction. For example, a ceiling insert used for fixing a hanging bolt is fixed as part of a slab when a floor slab (such as a reinforced concrete flooring) of the upper floor is cast. Such a work is mainly performed by workers of contractors performing civil engineering, and workers of contractors performing high-place work, earthwork and concrete construction. Next, the external construction of the building is performed (step S4). The outer walls are tiled, and window sashes, window glass, curtain walls, and the like are attached. Painting or the like is also performed.

Next, interior construction is performed (step S5). During interior construction, the ceiling, walls, and floors are built up. When performing ceiling construction for installing a ceiling, a ceiling member, which is a member that configures a ceiling surface such as a ceiling board or a ceiling base member, is attached to a base combined with lightweight steel frame members, with the hanging bolt hanging from the ceiling insert provided in the structural construction of step S3. Hanging members such as hanging bolts and hangers and diagonal members are used to support the ceiling member, with which danger prevention measures are taken in order to prevent the danger of the fall of a ceiling board.

For example, in Japan, provisions for preventing a ceiling from falling are stipulated in the Building Standard Act, Enforcement Order, and the like. Among these standards, one standard states that falling prevention measures such as securing the ceiling by using a hanging member is taken when a ceiling member satisfying a predetermined condition is used. For example, the air-conditioning device is a heavy device, and thus the falling prevention measures need to be taken. Further, regarding the lighting fixtures as well, a large and heavy lighting fixture such as a conventional so-called base lighting needs to be fixed by the hanging members.

Note that instead of installing the ceiling inserts used for fixing the hanging bolts during concrete casting, the hanging bolts can be fixed by fixing an anchor to the concrete after casting. However, in consideration of efficiency and safety, the ceiling insert is preferably disposed in advance, and for locations where it is known that hanging members will be provided, the position of the ceiling insert is preferably determined at the design stage and the ceiling insert is preferably embedded during concrete casting.

During interior construction, before the ceiling is finished, that is, before the ceiling is formed by the ceiling member, work is also performed of suspending pipes and air-conditioning ducts, and wires and the like are passed into the pipes. Therefore, space necessary for installing electrical wiring, ducts, air-conditioning devices, and the like is provided on the rear of the ceiling. Furthermore, an opening is provided in the ceiling member according to the locations where lighting or air-conditioning is installed. The work of installing ducts in the ceiling and securing the ceiling member by using the hanging member is performed by workers of contractors that perform interior construction. On the other hand, the work of providing the electrical wiring is carried out by specialized workers that can perform electric construction due to danger of electric shocks and the like.

It is assumed that the workers performing ceiling construction in which the ceiling is installed and the workers performing wiring work in which the electrical wires are passed through the rear of the ceiling are often different workers. Note that in Japan, electric construction such as wiring work is not permitted to be performed by a person not having electric construction credentials. Thus, when constructing buildings, workers that are dispatched from a variety of professional contractors performs specialized tasks, and this ensures the safety of workers.

In the present specification, a worker who prepares the ceiling member for construction of a building and performs ceiling construction is referred to as a ceiling installation worker. A worker who prepares electrical wire for construction of a building and performs wiring work is referred to as a wiring construction worker. Note that the construction described in each of the steps for construction of a building is typically performed by a plurality of workers. Therefore, a ceiling installation worker is not limited to a single worker and refers to one or more workers who perform ceiling construction when constructing buildings. The same applies to the wiring construction worker and other workers.

Next, when interior construction is completed and the floors, walls, and ceilings are finished, installation work is performed (step S6). In the installation work, equipment that is required when actually using the building is installed. For example, facilities for electricity, gas, water supply, water discharge, air-conditioning, toilets, disaster prevention, broadcasting, and the like, and facilities for lighting, escalators, elevators, and the like are installed. This works is performed by workers of contractors such as electric construction, electrical communication construction, water supply facility construction, fire extinguishing facility construction, and cleaning facility construction.

The installation work for lighting and air-conditioning needs to be carried out by a worker having electric construction credentials because those need to be electrically connected. Note that the position where the lighting is installed is not limited to a ceiling, but lighting fixtures installed on the ceiling are usually connected to the wirings provided on the rear of the ceiling and electrically connected by a worker having electric construction credentials. Even in a case in which an air-conditioning device is installed in the ceiling during facility construction for air-conditioning, the air-conditioning device is connected to the wirings provided on the rear of the ceiling by the worker having electric construction credentials.

Typically, in a room of a building such as an office building, a large lighting fixture or air-conditioning device disposed in a ceiling is fixed by using a hanging member. Therefore, a worker that performs the installation work of such a large lighting fixture or air-conditioning device can also perform work of fixing the large lighting fixture or air-conditioning device on a hanging member suspended from a ceiling insert and installing the large lighting fixture or air-conditioning device in the ceiling.

Note that it is not uncommon that the installation work of the lighting and the installation work of the air-conditioning are performed separately from each other. The manufacturer of the lighting fixtures manufactures lighting fixtures necessary for construction so as to ensure that the installation work of the lighting is completed on time. In a similar manner, the manufacturer of the air-conditioning devices manufactures air-conditioning devices necessary for construction so as to ensure that the installation work of the air-conditioning is completed on time. In this specification, a contractor that manufactures and provides lighting fixtures is referred to as a lighting fixture supplier, and a contractor that manufactures and provides air-conditioning devices is referred to as an air-conditioning device provider.

First Embodiment

Figure 2:
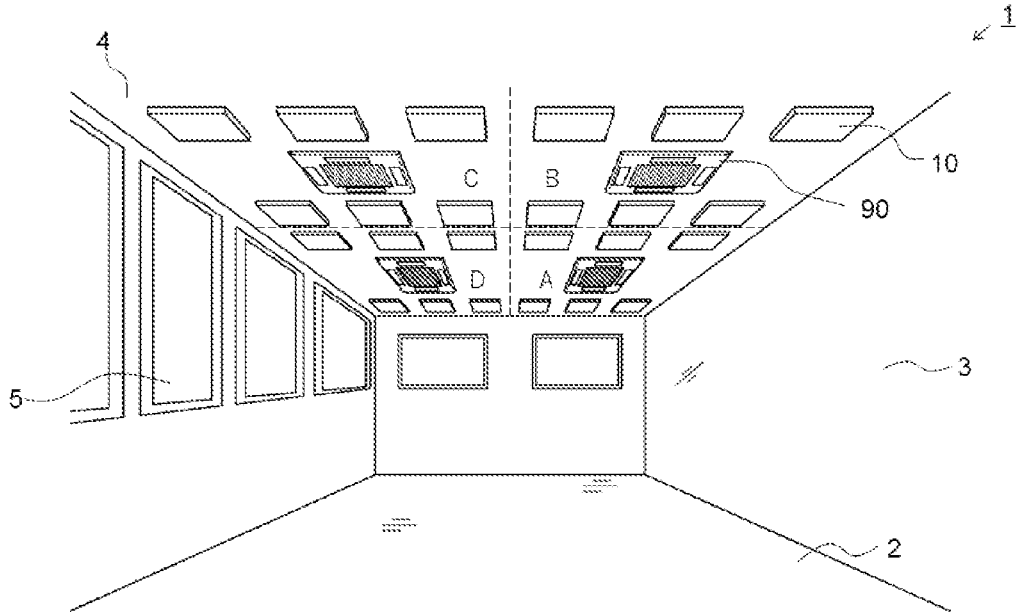
FIG. 2 is a schematic diagram illustrating an example of a structure of a room of a building according to an embodiment.

Next, a construction process of a building according to the first embodiment will be described. A building 1 according to the first embodiment has a multi-floor structure and includes corridors and rooms. Note that the building 1 can be a one-floor structure. FIG. 2 is a schematic diagram illustrating an example of a structure of a room on a specific floor of the building 1.

The building 1 forms a room space with a floor 2, walls 3, a ceiling 4, and a window 5. Note that the lateral surfaces of the room space can be configured by only the walls 3 without the windows 5. A plurality of lighting fixtures 10 and a plurality of air-conditioning devices 90 are installed in the ceiling.

For example, in a case of a building such as an office building, small ceiling installation instruments such as downlights are provided for lighting a narrow space such as a corridor, and a large lighting fixture such as, mainly, base lighting is provided across a wide space such as a room. In such a case, typically, a large number of large lighting fixtures are installed as the lighting fixtures 10 installed in the room, and small lighting fixtures are not installed or a small number of such small lighting fixtures are installed in a portion of a region of the room. Further, typically, in the room, the number of installed lighting fixtures 10 is greater than the number of installed air-conditioning devices 90.

In the room, the lighting fixtures 10 and the air-conditioning devices 90 are disposed in a regular pattern. In the example of FIG. 2, a structure in which one air-conditioning device 90 is interposed between two sets of three lighting fixtures 10 that are oppose to each other can be regarded as one set having regularity. Further, in the room, the lighting fixtures 10 and the air-conditioning devices 90 are disposed and installed in a pattern that the sets are arrayed in a matrix pattern. In an office, desks for employees to do their tasks are arrayed in multiples rows, and therefore the lighting fixtures 10 and the air-conditioning devices 90 are preferably disposed in a regular pattern so that a significant difference is not generated in an environment depending on a location.

In the example of FIG. 2, the ceiling 4 is divided into four imaginary regions by a broken line. As described above, there are four regions each forming a set, and, for the sake of convenience, the four regions are referred to as a region A, a region B, a region C, and a region D. Note that all of the regions need not include the same sets, that is, need not have the same disposition structures. Further, all of the regions need not necessarily have a layout having regularity. The ceiling 4 includes a plurality of regions each including one air-conditioning device 90 installed on the ceiling 4 and a plurality of lighting fixtures 10 installed around the air-conditioning device 90.

The lighting fixture 10 illustrated in FIG. 2 is a lighting fixture that has performance corresponding to that of base lighting as the performance of a lighting fixture; however, does not need to be fixed by a hanging member during lighting installation work. In other words, the lighting fixture 10 is a lightweight large lighting fixture that is large enough to be handled as a base lighting equivalent product while being lightweight so that a hanging member is not required.

The lightweight large lighting fixture in the present specification refers to a lighting fixture that meets at least one of the following requirements: total luminous flux is equal to or greater than 2500 lm; area of the light emitting surface, which is the surface closest to the floor, is equal to or greater than 45000 mm2, and 100 or more light source elements are disposed. Alternatively, in addition to this, the characteristics of the lightweight large lighting fixture can be further specified by a condition that the weight of the lighting fixture is in a range from 0.5 kg to less than 2.5 kg.

Figure 3:
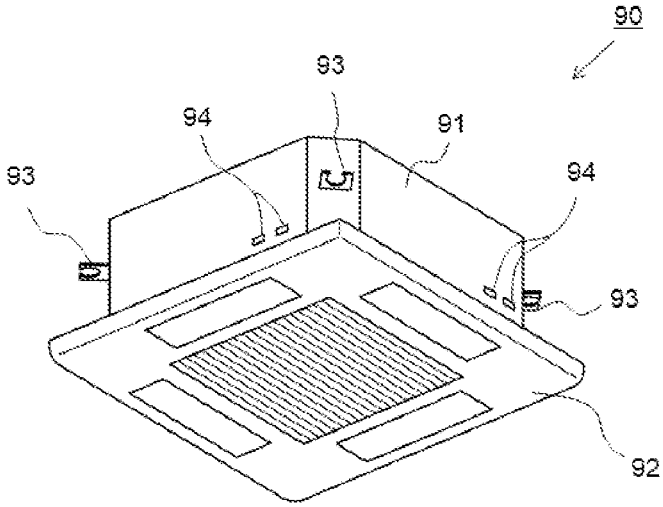
FIG. 3 is a perspective view of an air-conditioning device according to the embodiment.
Figure 4:
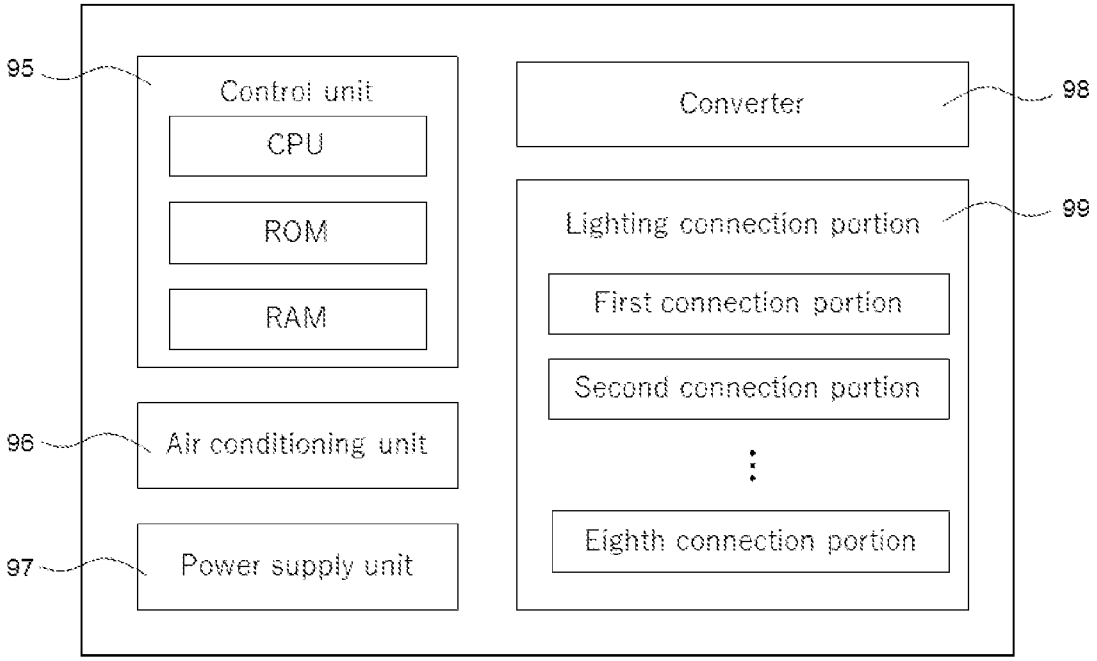
FIG. 4 is a block diagram for describing a hardware configuration of the air-conditioning device according to the embodiment.
Figure 5:
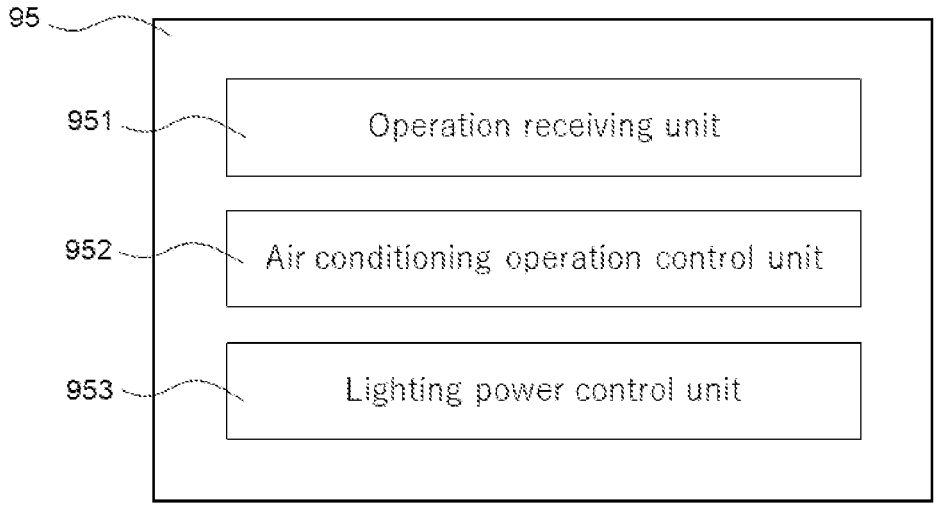
FIG. 5 is a block diagram for describing a software configuration of the air-conditioning device according to the embodiment.

Next, the air-conditioning device 90 will be described. FIG. 3 is a perspective view of the air-conditioning device 90. FIG. 4 is a block diagram for describing a hardware configuration of the inside of the air-conditioning device 90. FIG. 5 is a block diagram for describing a software configuration of the air-conditioning device 90.

The air-conditioning device 90 is an indoor unit of a ceiling embedded type, and includes, on its exterior, a casing 91, a ceiling surface panel 92, four fixing portions 93, and eight connector receiving portions 94. Further, on the inside surrounded by the casing 91 and the ceiling surface panel 92, the air-conditioning device 90 includes a control unit 95, an air-conditioning unit 96, a power supply unit 97, a converter 98, and a lighting connection portion 99.

The casing 91 includes a box-like body with its lower end surface being opened, and forms lateral surfaces and an upper surface of the air-conditioning device 90. The upper surface has a rectangular shape such as square shape or an oblong shape, and four lateral surfaces each correspond to a side of the upper surface, are in contact with each other at a right angle, and extend downwardly. A corner at an end portion at which one side and another side of the upper surface meet is cut, and the cut region also forms a straight side. Thus, in the lateral surfaces as well, plane surfaces are provided to correspond to the cut regions. As used herein, the four lateral surfaces corresponding to the rectangle shape are referred to as main lateral surfaces, and the lateral surfaces corresponding to the cut regions at the end portions are referred to end lateral surfaces.

In each of the four end lateral surfaces of the casing 91, the fixing portions 93 are provided. With the use of the fixing portions 93, the air-conditioning device 90 is fixed to hanging members 30. In each of the four main lateral surfaces of the casing 91, two connector receiving portions 94 are provided side by side in the horizontal direction. Connectors of wirings to be connected to the lighting fixtures 10 can be connected to the connector receiving portions 94. Note that the fixing portions 93 and the connector receiving portions 94 can be provided on the same lateral surface. Specifically, both of the fixing portions 93 and the connector receiving portions 94 can be provided on the end lateral surfaces. Alternatively, both of the fixing portions 93 and the connector receiving portions 94 can be provided on the main lateral surfaces. Further, the fixing portions 93 and the connector receiving portions 94 can be provided on both of the main lateral surfaces and the end lateral surfaces.

The ceiling surface panel 92 includes a lower surface forming the ceiling surface and an upper surface connected to the casing 91. Further, the ceiling surface panel 92 is attached to the casing 91 so as to cover the opening of the casing 91. Further, the ceiling surface panel 92 is provided with an air outlet for blowing out cool air, warm air, or the like produced by the air-conditioning unit 96 and an air inlet for taking in air in an indoor room. The upper surface and the lower surface of the ceiling surface panel 92 each have a rectangular shape such as a square shape or an oblong shape, and each of four sides is in parallel with a corresponding main lateral surface of the casing 91. Thus, the ceiling surface panel 92 is attached in such a manner that the direction of each side of the upper surface or the lower surface matches the direction of the main lateral surface of the casing 91.

The control unit 95 includes a ROM, a RAM, and a CPU. The ROM is a memory that stores various programs, data used by the programs, and the like. The RAM is a memory that is used as a storage space for loading a program, a work space for the loaded program, or the like. The CPU is a processor that implements various functions by processing the program loaded in the RAM.

The air-conditioning unit 96 includes an indoor heat exchanger, an indoor fan, and a drain pan. The indoor heat exchanger is a finned tube heat exchanger. At the time of cooling operation, the indoor heat exchanger functions as an evaporator of a refrigerant to cool indoor air, and at the time of heating operation, the indoor heat exchanger functions as a condenser of a refrigerant to heat indoor air.

The indoor fan is a cross flow fan, and includes a fan and a fan motor for rotating the fan. Further, the indoor fan takes in air of an indoor room and blows out air to the indoor room. The air taken in through the air inlet by the indoor fan is conditioned through heat exchange carried out by the indoor heat exchanger, and the conditioned air is blown out to the indoor room through the air outlet. The indoor fan can adjust the flow rate of the air to be supplied to the indoor heat exchanger within a predetermined flow rate range. The drain pan receives a drain, which is generated as a result of moisture in the air being condensed through the heat exchange carried out by the indoor heat exchanger.

The power supply unit 97 supplies a power voltage for causing the air-conditioning unit 96 to operate. Further, the power supply unit 97 supplies a power voltage to the lighting fixture 10 via the lighting connection portion 99. In a case in which the power voltage is supplied to the lighting fixture 10, the converter 98 converts the power voltage supplied from the power supply unit 97 into a power voltage that conforms to the standard of the lighting fixture 10. Thus, in a case in which the power voltage is supplied to the lighting fixture 10, the power supply unit 97 supplies the power voltage from the lighting connection portion 99 to the lighting fixture 10 via the converter 98.

The air-conditioning device 90 of the ceiling embedded type is connected to AC power source of 200 V, for example, and is supplied with the power voltage in order to control air-conditioning of a wide room space. On the other hand, the lighting fixture 10 operates with a DC power voltage of 100 V. In such a case, the converter 98 converts the AC power voltage of 200 V into the DC power voltage of 100 V. Note that the converter 98 can be connected to the air-conditioning device 90 with a wiring, instead of being incorporated into the air-conditioning device 90. In a case in which the power supply unit 97 supplies the power voltage to the lighting fixture 10, the power supply unit 97 supplies the power voltage that is converted by the converter.

The lighting connection portion 99 includes eight connection portions, namely, a first connection portion to an eighth connection portion. The eight connection portions and the eight connector receiving portions 94 correspond to each other on a one-to-one basis. The lighting connection portion 99 implements electrical connection for supplying the power voltage to the lighting fixture 10 that is connected to a wiring inserted into the connector receiving portion 94.

The control unit 95 configures functions of an operation receiving unit 951, an air-conditioning operation control unit 952, and a lighting power control unit 953. Each of these functional units is implemented by processing that the program causes the CPU to execute. The operation receiving unit 951 receives operation of the user performed for the air-conditioning device 90. Further, the operation receiving unit 951 receives operation of the user performed for the lighting fixture 10. The operation performed by the user is performed by using an operation unit installed on the wall 3 of the room or a portable and remote operation unit, for example, and its operation includes air-conditioning functions and ON/OFF of lighting.

The air-conditioning operation control unit 952 controls operation of the air-conditioning unit 96 and the power supply unit 97 in order to control the air-conditioning functions. For example, the air-conditioning operation control unit 952 causes the power supply unit 97 to supply the power voltage in order to drive a motor of the air-conditioning unit 96, and causes the indoor fan to function. The operation of the air-conditioning unit 96 is adjusted on the basis of an instruction command of the operation received by the operation receiving unit 951. For example, the air-conditioning function is controlled on the basis of details of an instruction command, such as that indicating whether the operation is the cooling operation or the heating operation, the degree of the set temperature, and the degree of the flow rate.

The lighting power control unit 953 controls supply of the power voltage to the lighting fixture 10 that is connected via the connector receiving portion 94. The lighting power control unit 953 causes the converter 98 to convert the power voltage from the power supply unit 97, and allows the power voltage appropriate for the lighting fixture 10 to be supplied from the connection portion connected to the lighting fixture 10.

Next, steps until the air-conditioning device 90 is installed in construction of the building 1 according to the first embodiment will be described. Note that points different from the steps until the construction of the building described above with reference to FIG. 1 will be described in detail, and the description of overlapping points will be simplified or omitted.

Figure 6:
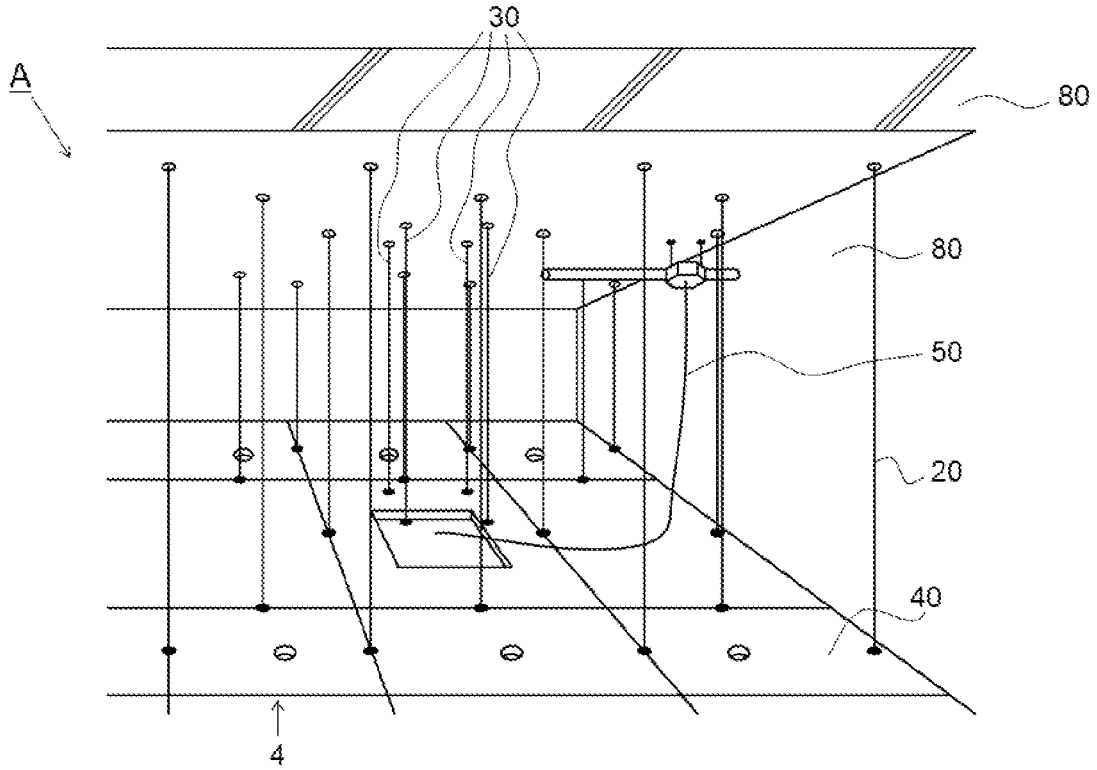
FIG. 6 is a diagram illustrating a structure of a ceiling rear space in a construction of a building according to the embodiment.

Steps from step S2 to step S4 are generally similar to those described above. Next, in the interior construction of step S5, ceiling construction is performed in which a ceiling is provided. Also, before the ceiling is finished, wirings to be disposed on the rear of the ceiling is passed at a position higher than a position of the ceiling. FIG. 6 illustrates an example of the rear of the ceiling in a state in which ceiling construction has been performed. Further, FIG. 6 illustrates an example of the rear of the ceiling in the region A of the room of FIG. 2.

As illustrated in FIG. 6, the rear of the ceiling has a space defined by an upper surface, a lower surface, and lateral surfaces such that a structural body 80 where concrete is cast forms the upper surface and the lateral surfaces of the space and the ceiling 4 where ceiling members 40 are disposed forms the lower surface of the space. Each ceiling member 40 that forms the ceiling 4 is fixed and supported by hanging members 20 connected to a ceiling insert of the structural body 80. Further, to fix the air-conditioning device 90, four hanging members 30 are provided for one air-conditioning device 90. Note that the number of hanging members 30 provided for one air-conditioning device 90 need not be limited to four. At the time point of FIG. 6, the air-conditioning device 90 is not attached yet, and the hanging members 30 do not support the air-conditioning device 90.

In the space of the rear of the ceiling, a wiring 50 provided to pass through a pipe is provided. The wiring is provided for the number of installed air-conditioning devices 90 that are installed on the rear of the ceiling, based on the design drawing. The wiring 50 is passed through the pipe and is provided for receiving supply of the power voltage from the external power source. In the example herein, the power voltage supplied to the air-conditioning device 90 is greater than the voltage supplied to the lighting fixture 10 and, the air-conditioning device 90 can be supplied and received with the AC power voltage of 200 V via the wiring 50 connected thereto. Note that the wiring is not limited to be a wiring provided for the air-conditioning device 90. A number of wirings sufficient for the supply of power to other electrical connection devices are provided, and the ceiling 4 is provided.

Figure 9:
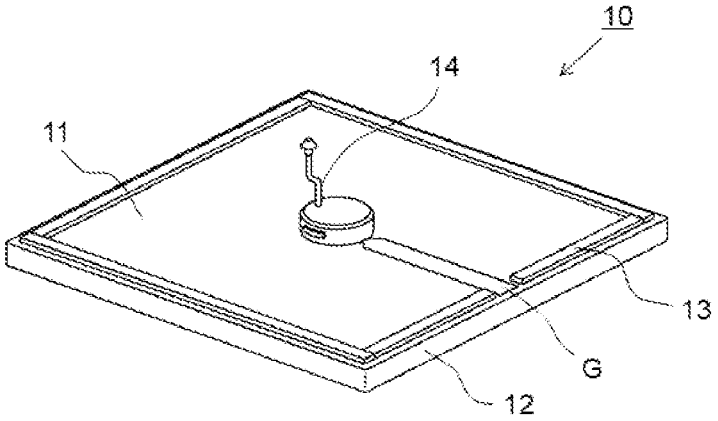
FIG. 9 is a perspective view of a lighting fixture according to the embodiment.

The ceiling member 40 is provided with an opening for installing a ceiling installation instrument, such as the air-conditioning device 90 and the lighting fixture 10. A quadrilateral opening is an opening for the air-conditioning device 90, and a circular opening is an opening for the lighting fixture 10. In the example of FIG. 9, among a total of nine (=3×3) ceiling members 40, one ceiling member 40 located at the center is provided with the opening for installing the air-conditioning device 90. Further, each of the three ceiling members 40 located on both sides of the one ceiling member is provided with the opening for installing the lighting fixture 10. In the regions B to D as well, the hanging members 20, the hanging members 30, the ceiling members 40, and the wiring 50 are provided in a similar manner, although there is a difference in the disposition relationship with the structural body 80.

Figure 7:
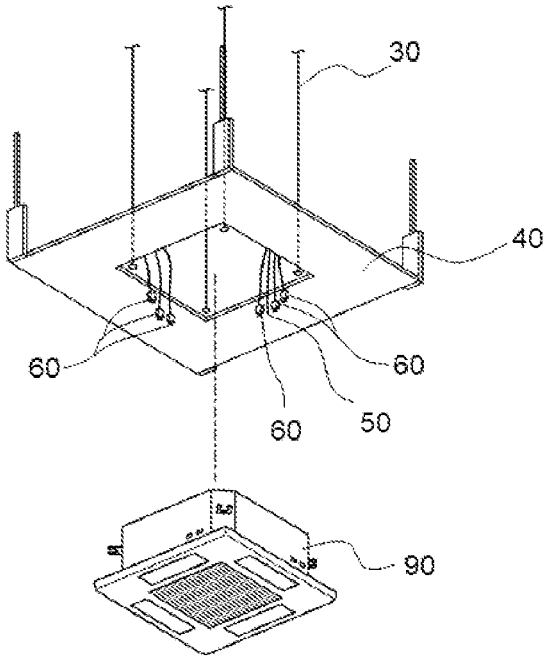
FIG. 7 is a diagram for describing a method of installing the air-conditioning device according to the embodiment.
Figure 8:
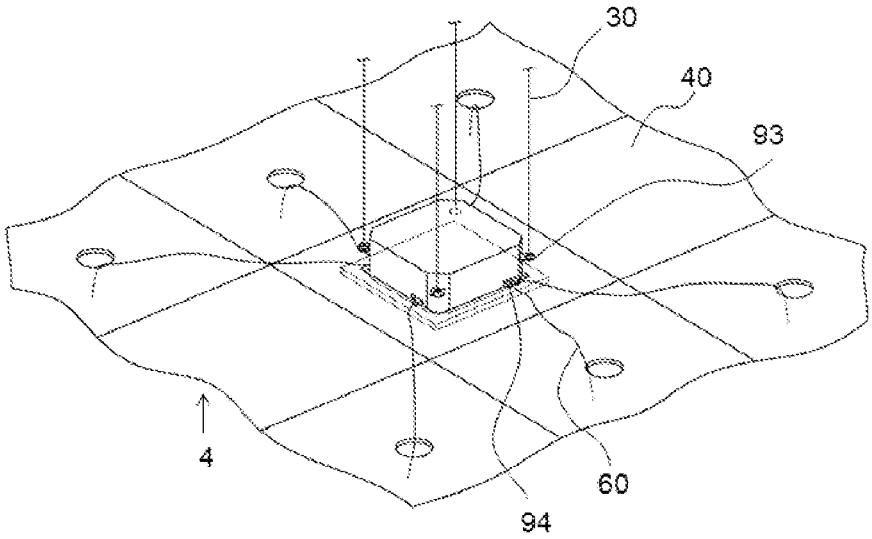
FIG. 8 is a diagram for describing a state in which the air-conditioning device is installed on a ceiling according to the embodiment.

After the ceiling 4 is provided in this manner, the installation work of the air-conditioning device 90 is performed in the facility construction of step S6. FIG. 7 and FIG. 8 are each a diagram for describing a method of installing the air-conditioning device 90. FIG. 7 illustrates a connection relationship between the hanging members 30, the ceiling member 40, and the air-conditioning device 90 in an aspect as seen from the ceiling surface side (room space side). Further, FIG. 8 illustrates a structure of a state in which the air-conditioning device 90 is installed on the ceiling as seen from the side of the rear of the ceiling.

Note that in a case in which the ceiling 4 is provided in the building, the room space, which is the space that forms the room illustrated in FIG. 2, and the ceiling rear space, which is the space that forms the rear of the ceiling illustrated in FIG. 6, are regarded as distinct spaces separated by the ceiling surface. Note that the ceiling surface refers to a plane surface in which the ceiling member is installed. In other words, with the ceiling surface as a boundary, an upper (above) space of the ceiling 4 corresponds to the ceiling rear space, and a lower (below) space of the ceiling 4 corresponds to the room space. Further, for example, in a case of a building having two or more floors, the ceiling rear space of the first floor is provided below the room space of the second floor with the structural body therebetween.

As illustrated in FIG. 7, before the air-conditioning device 90 is fixed to the hanging members 30 to close the opening in the ceiling member 40, wirings 60 each provided with a connector are passed through the rear of the ceiling and provided in the ceiling rear space. On the other hand, the wiring 50 is not provided with a connector. In a case in which the opening for the air-conditioning device 90 is closed, the wirings 60 can be provided after the air-conditioning device 90 is fixed to the hanging member 30. The wiring 60 is a wiring cable for enabling connection with the lighting fixture 10. Further, the air-conditioning device 90 in the region A is connected to the lighting fixture 10 to be installed in the region A. Thus, the wirings 60 are provided for the number of lighting fixtures 10 to be connected to the air-conditioning device 90 in the region A. In the example of FIG. 6, six wirings 60 are provided. Note that, for the sake of convenience, to distinguish the wiring 50 and the wiring 60, the wiring 50 can be referred to as a first wiring, and the wiring 60 can be referred to as a second wiring.

To supply power to the air-conditioning device 90, connection work with the wiring 50 is performed. In Japan, the work needs to be performed by a person who has electric construction credentials. Further, the connectors of the six wirings 60 are each inserted into six of the eight connector receiving portions 94 of the air-conditioning device 90 so as to be connected to the lighting connection portion 99. The work can be performed even by a person who does not have electric construction credentials. The connector can be inserted into any connector receiving portion 94. However, the connector is preferably inserted into the connector receiving portion 94 that is located at a position close to the lighting fixture 10. This is for the purpose of preventing entanglement of the wirings and crossing of the wirings to the extent possible.

The reason why a plurality of connector receiving portions 94 are provided on each of the four main lateral surfaces of the air-conditioning device 90 is to flexibly accommodate the disposition relationship between the air-conditioning device 90 and the lighting fixture 10, that is, the layout of the ceiling 4 in the room. Note that the number of the connector receiving portions 94 and the connection portions of the lighting connection portion 99 need not be limited to eight. Note that, with a relationship between an air-conditioning region covered by one air-conditioning device 90 of the ceiling embedded type and a lighting region covered by one lighting fixture 10 being taken into consideration, the air-conditioning device provided with four or more connector receiving portions 94 is preferable.

Further, the connector receiving portions 94 can be provided on two main lateral surfaces that face each other, instead of being equally provided on all of the four main lateral surfaces. Further, in view of flexibly accommodating the layout, it is desirable that the connector receiving portions be provided on a plurality of main lateral surfaces. This, however, does not mean that the air-conditioning device provided with four or more connector receiving portions on one main lateral surface cannot have wiring connection with the lighting fixtures, and wiring connection can be achieved with such an air-conditioning device. In a case in which the number of connector receiving portions to be provided for a single air-conditioning device is excessively large, there are a large number of connector receiving portions left unused, which leads to inefficiency. Thus, the number of connector receiving portions to be provided for a single air-conditioning device is preferably 16 or less. The air-conditioning device may be provided with 17 or more connector receiving portions.

As illustrated in FIG. 8, the air-conditioning device 90 to which six wirings 60 are connected is fixed to the hanging members 30 with the fixing portions 93, and is installed on the ceiling. Further, each of the six wirings 60 passes through the opening in the ceiling member 40 corresponding to each lighting fixture 10 to be installed around the air-conditioning device 90. Through such an opening, the lighting fixture 10 and the wiring 60 are connected to each other, and are installed on the ceiling member 40. Note that the air-conditioning device 90 is connected to the wiring 50 at a stage before being installed on the ceiling; however, the wiring 50 is omitted in FIG. 8.

Figure 10:
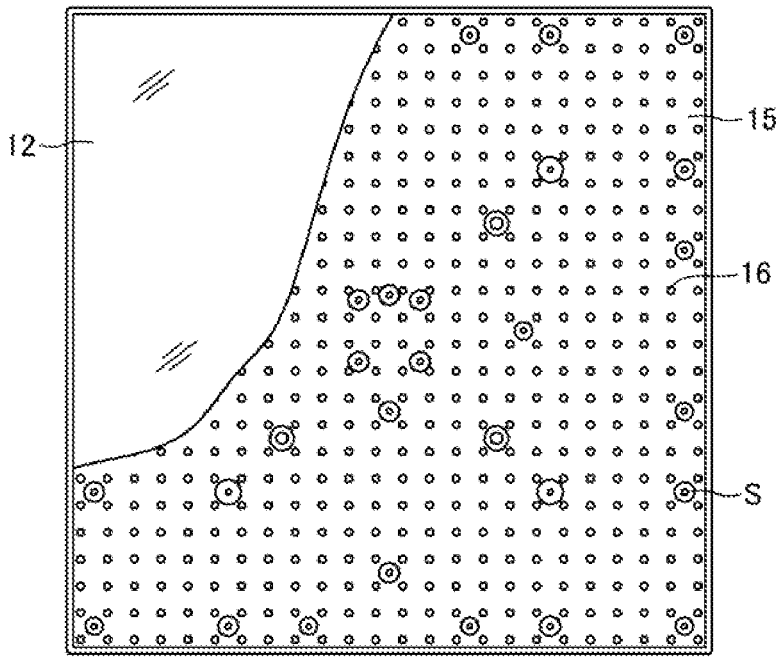
FIG. 10 is a schematic diagram for describing a light emitting surface of the lighting fixture according to the embodiment.
Figure 11:
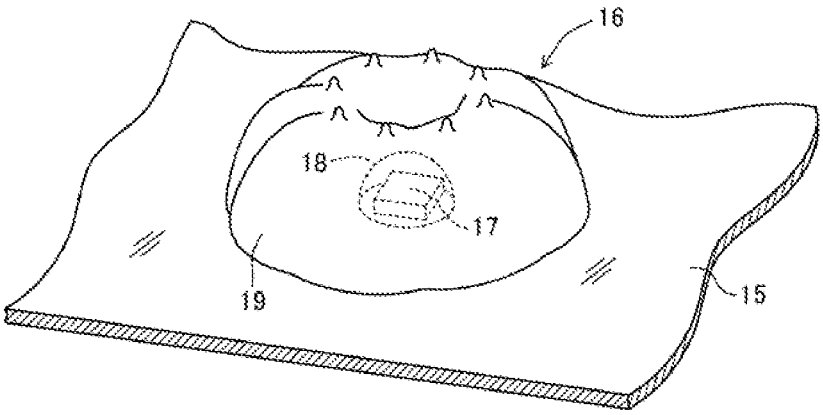
FIG. 11 is a perspective view of a light source element in the lighting fixture according to the embodiment.

Next, the lightweight large lighting fixture being an example of the lighting fixture 10 to be installed on the ceiling member 40 will be described. FIG. 9 is a perspective view of the lighting fixture 10 as seen from an installation surface to be installed on the ceiling. FIG. 10 is a schematic diagram for describing a light emitting surface of the lighting fixture 10. FIG. 11 is a perspective view illustrating light source elements 16 to be used for the lighting fixture 10. The lighting fixture 10 described with reference to FIG. 10 and FIG. 11 is a lighting fixture having a length of 450 mm, a width of 450 mm, and a height from a ceiling installation surface to a light emitting surface of 20 mm, with the light emitting surface having a square shape.

Note that the light emitting surface of the lighting fixture can be a square shape with a length of 600 mm and a width of 600 mm. Further, the light emitting surface of the lighting fixture can be an oblong shape with a length of 150 mm and a width of 600 mm. In this manner, the length and the width are preferably set in increments of 150 mm, with the aim of conforming to the specifications of the ceiling members. In other words, the length and the width are set to be a multiple of 150 mm, so as to be handled similarly to the ceiling members. In other words, as long as a size conforming to the specifications of the ceiling members is employed, the length and the width need not be set to be a multiple of 150 mm. For example, in an area where a foot is used as the unit of dimension, the length and the width can be set to a multiple of one foot.

Note that an oblong lighting fixture with a length of 75 mm and a width of 600 mm can be used. Further, the light emitting surface having other polygonal shapes, a circular shape, an elliptical shape can be used, and the shape is not limited. Further, in the present application, figures with their four corners being chamfered, for example, are also referred to as a square shape or an oblong shape.

The lighting fixture 10 includes a base plate 11, a cover 12, a buffer 13, a DC harness 14, a substrate 15, and light source elements 16. The base plate 11 functions as a reinforcement plate or a heat dissipation plate in the lighting fixture 10. For example, the base plate 11 is a metal plate formed into a rectangle shape. For example, the metal plate can be formed with its material being aluminum.

Note that the "light source" in this specification refers to a member that emits light, and the light source can be a light emitting element as typified by an LED, or can be a combination of a light emitting element and a wavelength conversion member. The term "wavelength conversion member" refers to a member that converts a portion or all of light emitted from the light emitting element into light with another wavelength, examples of which include a phosphor member.

The cover 12 is provided to cover the light source elements 16 disposed on the substrate 15. Further, the cover 12 can transmit the light emitted by the light source elements 16. The cover 12 is formed, for example, in a milky white color having light diffusivity achieved by dispersing titanium oxide or the like in a resin material. As the resin material, for example, acrylic resin can be adopted, and for example, polymethyl methacrylate resin can be adopted.

The buffer 13 is provided on an outer periphery of the ceiling installation surface of the base plate 11. The buffer 13 prevents direct contact between the ceiling installation surface of the base plate 11 and the ceiling 4 (or the ceiling member 40) and buffers an impact. Further, the buffer 13 is not provided at a portion of the outer periphery of the base plate 11, and due to the thickness of the buffer 13, a removable arm insertion port G is formed.

The DC harness 14 is to be fitted into a socket 70 to be described later. The socket 70 is attached to the ceiling member 40, and the DC harness 14 is attached to the ceiling 4 via the socket 70.

The substrate 15 is, for example, an electrically insulating substrate made of resin or ceramics, and includes a light source placement surface on which a plurality of light source elements 16 are placed. Further, on the light source placement surface of the substrate 15, a conductive pattern for supplying power to the light source elements 16 is provided. The material of the conductive pattern can be selected as appropriate depending on a main material of the substrate 15. For example, in a case of a substrate made of ceramics, the material of the conductive pattern is preferably a material having such a high melting point that the conductive pattern can withstand firing temperature of a ceramics sheet. For example, the material of a conductive wiring can be a material containing metal having a high melting point, such as tungsten and/or molybdenum. In addition, the material can be a material in which another metal material such as nickel, gold, and/or silver is provided as a coating material on the above-mentioned material by plating, sputtering, and vapor deposition. Further, in a case of a substrate made of a resin material, the material of the conductive pattern is preferably a material that can be easily subjected to treatment. For example, in a case in which a substrate is made of a resin that is subjected to injection molding, the material of the conductive pattern is preferably a material that can be easily subjected to treatment such as punching, etching, or bending, and that has a relatively great mechanical strength. Specific examples of the material of the conductive pattern can include metal such as copper, aluminum, gold, silver, tungsten, rhodium, iron, nickel, and molybdenum, as well as an alloy containing iron and nickel, phosphor bronze, and copper containing iron.

FIG. 6 illustrates a diagram of a case in which a portion covered by the cover 12 is removed so that the structure inside the cover 12 can be seen. Accordingly, in actuality, the substrate 15 and the light source elements 16 in the lighting fixture 10 are covered by the cover 12. The surface on the opposite side of the light source placement surface of the substrate 15 comes into contact with the base plate 11. The substrate 15 is provided with a plurality of screw holes S, and is screwed to the base plate 11 through the screw holes S.

The light source elements 16 are arrayed on the substrate 15 at regular intervals. On the 450-mm square light source placement surface, the light source elements 16 are disposed at pitch intervals in a range from 15 mm to 20 mm. As illustrated in FIG. 7, the light source element 16 includes a light emitting element 17, a wavelength conversion member 18, and a sealing member 19. The light emitting element 17 is mounted on the light source placement surface of the substrate 15, and electrodes of the light emitting element 17 are electrically connected to the conductive pattern formed on the substrate 15. The wavelength conversion member 18 covers the light emitting element 17.

The sealing member 19 has an electrical insulation property and can transmit light emitted from the light source (for example, transmittance of 70% or greater). As the material of the sealing member 19, a material having fluidity before being solidified (for example, before curing is completed) can be adopted. For example, the material of the sealing member 19 can include a resin material, examples of which can include silicone resin, epoxy resin, phenolic resin, polycarbonate resin, acrylic resin, TPX resin, and polynorbornene resin, or a modified resin or a hybrid resin of these. In particular, the silicone resin is preferable in that the silicone resin is excellent in heat resistance and/or light resistance (the "silicone resin" used in this specification refers to a "silicone-based resin" comprehensively including a modified resin thereof or a resins at least having a silicone skeletal structure). Such a sealing material can additionally contain, as necessary, a filler and/or a phosphor, for example.

The sealing member 19 covers the wavelength conversion member 18. In the sealing member 19, a portion that covers around the center of the upper surface of the light emitting element 17 is recessed. Further, a plurality of protrusions are provided at a peripheral portion that surrounds the recessed portion described above. The protrusions are provided around the recessed portion roughly at regular intervals, and the recessed portion is located within a region surrounded by a straight line connecting adjacent ones of the protrusions. In this manner, due to the sealing member 19 that has a flat shape as a whole and that includes the recessed portion and the plurality of protrusions, the light source element 16 has a batwing light distribution characteristic.

Note that, to obtain a preferable batwing light distribution characteristic, the size of the protrusions is preferably not excessively large. For example, where the height of the protrusion of the sealing member 19 is represented as "h" and the height of the bulge (the height of the sealing member except the protrusions) is represented as "H", $0<h\leq H/8$ is preferably satisfied, $0<h\leq H/10$ is more preferably satisfied, and $0<h\leq H/12$ is yet more preferably satisfied.

Further, regarding the sealing member 19, at least a maximum thickness dimension is less than a maximum width dimension. For example, the maximum width is at least twice as large as the maximum thickness. Note that the maximum thickness is preferably a height from the substrate 15 to the top of the protrusions of the sealing member 19. Because of the sealing member having a flat shape as described above, batwing light emission can be achieved from a position of a smaller height. Further, this can also prevent inconvenience in that the light source element 16 is removed from the substrate due to an accidental external force.

As an example of the lighting fixture 10 having a length of 450 mm, a width of 450 mm, and a height from the ceiling installation surface to the light emitting surface of 20 mm as described above, the lighting fixture in which a total of 576 (24 in lengthwise direction×24 in widthwise direction) light source elements 16 are disposed has a total luminous flux of 4500 lm, a color temperature of 5000K, and a weight of 1.94 kg. In other words, the lighting fixture 10 according to one example is an example of the lightweight large lighting fixture that satisfies one or more of the following requirements: the total luminous flux is equal to or greater than 4000 lm; the area of the light emitting surface, which is the surface closest to the floor, is equal to or greater than 202500 mm2; 500 or more light source elements are disposed; and the weight is less than 2.0 kg.

Further, as another example of the lighting fixture 10 being different in that its light emitting surface has a length of 150 mm and a width of 600 mm, the lighting fixture in which a total of 256 (8 in lengthwise direction×32 in widthwise direction) light source elements 16 are disposed has a total luminous flux of 3450 lm, a color temperature of 2700K, and a weight of 1.09 kg. In other words, the lighting fixture 10 according to another example is an example of the lightweight large lighting fixture that satisfies one or more of the following requirements: the total luminous flux is equal to or greater than 3000 lm; the area of the light emitting surface, which is the surface closest to the floor, is equal to or greater than 90000 mm2; 200 or more light source elements are disposed; and the weight is less than 1.5 kg.

Figure 12:
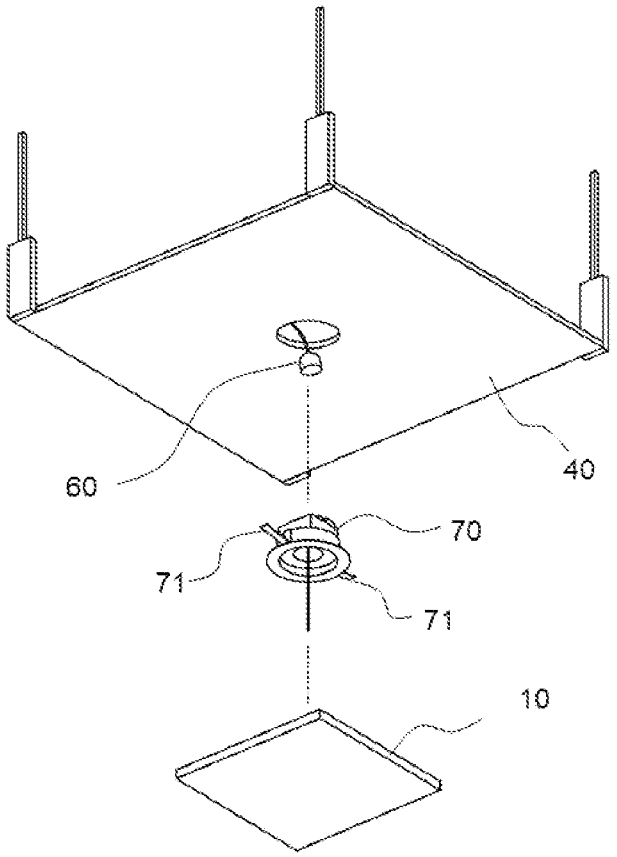
FIG. 12 is a diagram for describing a method of installing the lighting fixture according to the embodiment.

Next, an installation step of the lighting fixture 10 in construction of the building 1 according to the present application will be described. FIG. 12 illustrates a connection relationship between the ceiling member 40, the wiring 60, the socket 70, and the lighting fixture 10 in an aspect as seen from the ceiling surface side. The wiring 60 is provided with a connector to be connected to the lighting fixture 10, at another end of the wiring 60 which is located on the opposite side of one end at which a connector to be connected to the air-conditioning device 90 is provided. Note that the connector herein can be of the same type as the connector to be connected to the air-conditioning device 90, or can be of a different type. Note that, for the sake of convenience, to make a distinction, the connector to be connected to the air-conditioning device 90 can be referred to as a first connector, and the connector to be connected to the lighting fixture 10 can be referred to as a second connector.

In the ceiling construction, the work of passing the wiring in the rear of the ceiling is performed by a wiring construction worker having electric construction credentials. Further, the connection work between the air-conditioning device 90 and the wiring 50 is also performed by an air-conditioning installation worker having electric construction credentials.

Meanwhile, the wiring 60 provided with the first connector and the second connector can be provided in advance as a wiring cable having a length of several meters or greater. Further, as the wiring cable, for example, a LAN cable, which can perform both of supply of power and communication, can be used. In a case in which the wiring 60 provided with an electric shock prevention connection instrument such as the first connector and the second connector is used, the work of connecting the lighting fixture 10 to the wiring 60 can be performed without a person having electric construction credentials. In other words, in a case in which the work of connecting the wiring 50 and the air-conditioning device 90 has been completed, a person other than a person having electric construction credentials can perform the installation work of the lighting fixture 10, including the wiring connection work for supplying power to the lighting fixture 10.

As illustrated in FIG. 12, the opening provided for installing the lighting fixture 10 is smaller than the ceiling member 40. The opening is also sufficiently smaller than the light emitting surface of the lighting fixture 10. Note that, in this specification, in a case in which the size of the opening is ⅓ or less with respect to the area of the light emitting surface, the opening is described as being sufficiently small. Further, in a case in which the size of the opening is ⅕ or less with respect to the area of the light emitting surface, the opening is described as being significantly small. Further, in a case in which the size of the opening is 1/10 or less with respect to the area of the light emitting surface, the opening is described as being extremely small.

The opening for installing the lighting fixture 10 is formed, for example, into a circular shape with a diameter in a range of from 10 cm to 15 cm. The shape of the opening need not be circular, and can have a polygonal shape with a maximum diameter of 15 cm or less. The shape of the opening can be determined according to the size and shape of the socket 70 or other factors. Note that, as will be described later, to attach the lighting fixture 10, the opening preferably has a dimension in which the arm of a worker can pass through the opening to take the wiring 50 from the room side by hand.

As a specific example of the opening, a circular opening having a diameter of 15 cm is provided in order to install the lighting fixture 10 having a length of 450 mm, a width of 450 mm, and a height from the ceiling installation surface to the light emitting surface of 20 mm. Thus, the lighting fixture 10 can be installed by using the extremely small opening. Further, as another example, a circular opening of 12.5 cm is provided in order to install the lighting fixture 10 having a length of 150 mm, a width of 600 mm, and a height from the ceiling installation surface to the light emitting surface of 20 mm. Thus, the lighting fixture 10 can be installed by using the significantly small opening.

Note that the ceiling member 40 need not be provided with an opening in advance. It is common to prepare a ceiling member 40 without an opening and have a worker form an opening by creating a hole in the ceiling member 40 at the site where the interior construction is performed. The work of forming an opening in a ceiling member 40 with no opening can be performed as appropriate. The shape of the opening to be provided can also vary depending on what kind of ceiling installation instrument is installed. Thus, the opening can be formed when the ceiling member 40 is fixed by the hanging member 20 and attached to the ceiling, or can be provided after the ceiling is formed.

A worker present in the room space prepares the lighting fixture 10 and the socket 70 in the room space, and inserts the DC harness 14 of the lighting fixture 10 into the socket 70. Further, using a fitting portion of the socket 70 and a fitting portion of the lighting fixture 10, the lighting fixture 10 and the socket 70 are fitted and fixed to each other. Then, the second connector of the wiring 60 is inserted into the socket 70, and thus, the lighting fixture 10 is electrically connected, and can be supplied with the power voltage from the external power source via the air-conditioning device 90.

The socket 70 includes a connector receiving portion that serves as a connection portion to be connected to the second connector of the wiring 60. The worker present in the room space can perform the connection work by pulling the wiring 60 that passes through the ceiling rear space into the room space. Note that for a case in which the lighting fixture 10 has a lighting control function that adjusts the intensity and/or tone of light emission, the socket 70 can separately include the connector receiving portion as the connection portion to be connected to a lighting control driver device that controls the lighting control. Note that, for the sake of convenience, to make a distinction, the connector receiving portion provided for supply of power can be referred to as a connector receiving portion for power, and the connector receiving portion provided for lighting control can be referred to as a connector receiving portion for lighting control.

Further, the socket 70 includes fasteners 71, and the worker present in the room space installs the socket 70 on the ceiling member 40 by using the fasteners 71. Each fastener 71 has springiness (elasticity) and is caused to penetrate through the opening in the ceiling member 40 from the ceiling surface side (the room space side). After penetrating through the opening, the fasteners 71 are hooked on the ceiling rear surface of the ceiling member 40, and thus load is applied to the ceiling member 40. In a case in which the lighting fixture 10 is attached to the ceiling 4, the load of one lighting fixture 10 and one socket 70 is applied to one ceiling member 40. Note that the fastener 71 is not limited to a structure having springiness and can be any structure that applies load to the ceiling member 40.

Note that either work of connecting the connector of the wiring 60 and the socket 70 or work of connecting the socket 70 and the lighting fixture 10 can be performed first. The work of attaching the socket 70 to the ceiling member 40 can be performed before or after the lighting fixture 10 is connected to the socket 70. Further, the socket 70 can be integrally formed with the lighting fixture 10 in advance. In other words, the lighting fixture 10 provided with the socket and the second connector of the wiring 60 can be connected to each other.

As one example, the socket 70 to be attached to the circular opening having a diameter of 150 mm has the following shape: a penetration region thereof to pass through the opening except the fasteners 71 has a circular shape having a diameter of 148 mm, and a ceiling surface side thereof to come into contact with the ceiling surface has a circular shape having a diameter of 160 mm. Further, the load to be applied to the ceiling member 40 is 2.00 kg, combined with the weight of the lighting fixture 10 having a length of 450 mm, a width of 450 mm, and a height from the ceiling installation surface to the light emitting surface of 20 mm.

Further, as another example, the socket 70 to be attached to the circular opening having a diameter of 125 mm has the following shape: the penetration region thereof to pass through the opening except the fasteners 71 has a circular shape having a diameter of 123 mm, and the ceiling surface side thereof to come into contact with the ceiling surface has a circular shape having a diameter of 130 mm. Further, the load to be applied to the ceiling member 40 is 1.10 kg, combined with the weight of the lighting fixture 10 having a length of 150 mm, a width of 600 mm, and a height from the ceiling installation surface to the light emitting surface of 20 mm.

As one reference, the ceiling installation instrument that applies a load of less than 3.0 kg to the ceiling member 40 can be installed on the ceiling without the need to be fixed with the hanging member 20. In this regard, in any of the examples described above, the socket 70 and the lighting fixture 10 are installed on the ceiling member 40, and the load thereof totals less than 3.0 kg.

As described above, since the installation work of the lighting fixture 10 does not require the hanging member 20 to fix the lighting fixture 10, it is sufficient that an opening is provided only to pull out the wirings 60 on the rear of the ceiling into the room space. In other words, to perform the work of installing the lighting fixture 10 on the ceiling 4, it is sufficient that an opening with a size that allows an arm to pass through is present.

Further, even a person not having electric construction credentials can perform the connection work between the lighting fixture 10 and the wiring 60. In other words, the connection work can be performed with a method that is permitted to be executed even by a person not having electric construction credentials. In other words, this means that the installation work of the lighting fixture 10 can be efficiently performed in parallel with the installation work of the air-conditioning device 90 in the construction of the building 1. In still other words, the installation work of the lighting fixture 10 and the air-conditioning device 90 can be collectively performed in a manner in which, for example, a person having electric construction credentials performs wiring work of the air-conditioning device 90 and a person not having electric construction credentials performs the installation work of the lighting fixture 10 around the air-conditioning device 90. Note that the installation step of the lighting fixture 10 can be performed prior to the installation step of the air-conditioning device 90.

In the room in which the lighting fixtures 10 and the air-conditioning device 90 are installed in the manner described above, as illustrated FIG. 2, an efficient system in which the air-conditioning device 90 controls supply of power to the lighting fixtures 10 located near the air-conditioning device 90 can be constructed. In the example of FIG. 2, in each of the regions A to D, the air-conditioning device 90 installed in the region controls supply of power to the lighting fixtures 10 installed in the region. This allows the air-conditioning device 90 to control lighting in its own air-conditioning range as well.

The plurality of lighting fixtures 10 installed on the ceiling 4 is preferably connected to the air-conditioning device 90 located at a position closest to the lighting fixtures 10 via the wirings 60. Further, the distance between the air-conditioning device 90 and each of the lighting fixtures 10 located closest to the air-conditioning device 90 is preferably 1.0 m or less. The connection relationship between each of the lighting fixtures 10 and the air-conditioning device 90 in the room of FIG. 2 satisfies the above requirement.

Further, the air-conditioning device 90 need not be connected to the lighting fixtures 10 using all of the connector receiving portions 94, and can be connected to an appropriate number of lighting fixtures 10 according to a layout of the room. In a case in which the lighting fixtures 10 to be connected are changed as well, it is only necessary that the connected wiring 60 be disconnected and the wiring 60 of the lighting fixture 10 to be newly connected be inserted into the connector receiving portion 94, and thus the change of the lighting fixtures 10 to be controlled by the air-conditioning device 90 can be easily performed. In particular, since the lightweight large lighting fixture is used for the lighting fixture 10, for example, in a case in which the disposition place and the number of lighting fixtures 10 need to be changed after structural construction has completed, the hanging member need not be newly provided, which can flexibly accommodate the change. Further, the use of the air-conditioning device 90 can accommodate the change of the number of lighting fixtures 10 whose supply of power is to be controlled.

The example has been described in which each lighting fixture 10 is connected to each connector receiving portion 94 of the air-conditioning device 90. However, supply of power can be performed in a manner in which one lighting fixture 10 that is connected to the wiring 60 connected to the connector receiving portion 94 and another lighting fixture 10 are connected to each other with another wiring such that power is relayed therebetween. In this case, the power can be supplied to the plurality of lighting fixtures 10 on the condition that at least one connector receiving portion 94 is provided. Further, the connection between the lighting fixtures 10 can be implemented with the wiring 60 that is provided with the first connector connected to the lighting fixture 10 for receiving supply of power from the air-conditioning device 90 at one end and provided with the second connector at another end. In any case, the wirings 60 are provided for the number of lighting fixtures 10 that receive supply of power from the air-conditioning device 90. Further, the air-conditioning device 90 serves to control supply of power to the plurality of lighting fixtures 10 installed near the air-conditioning device 90. Note that one air-conditioning device 90 is preferably required to power to four or more lighting fixtures 10 located near the air-conditioning device 90.

Figure 13:
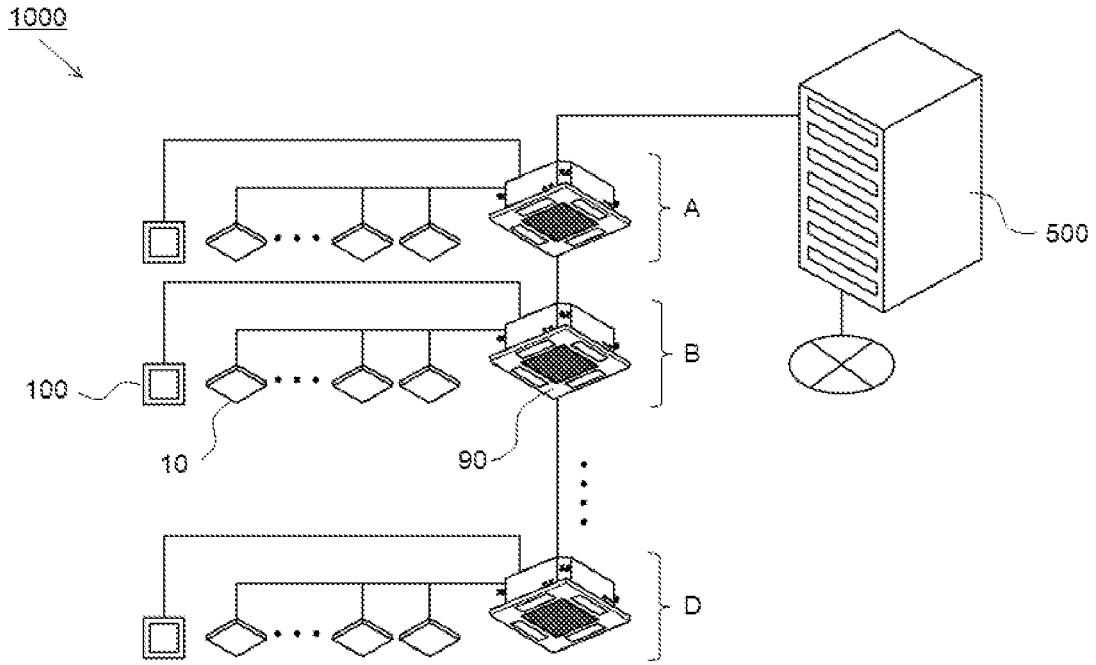
FIG. 13 is a diagram illustrating a system configuration of a device control system implemented in a building according to the embodiment.

FIG. 13 is an example of a device control system 1000 that manages output of the lighting fixtures 10 and the air-conditioning device 90 in the room of FIG. 2. The device control system 1000 includes a plurality of air-conditioning devices 90 that are installed in the regions A to D, a plurality of lighting fixtures 10 connected to the respective air-conditioning devices 90, operation units 100 for operating the respective air-conditioning devices, and a remote server 500 that manages air-conditioning and lighting of the whole of the building 1 or the room. In the device control system 1000, the air-conditioning device 90 is communicably connected to the operation unit 100 and the remote server 500. Further, the air-conditioning device 90 can control operation of the connected lighting fixtures 10 via the lighting connection portion 99. The air-conditioning device 90 receives an instruction command from the operation unit 100 or the remote server 500 at the operation receiving unit 951, and the air-conditioning device 90 performs output control of the air-conditioning device 90 itself and the lighting fixtures 10 connected to the air-conditioning device 90. Note that, in the device control system 1000, the remote server 500 is not essential.

With the device control system 1000 as described above, for example, the user can perform collective operation of the air-conditioning device 90 and the lighting fixtures 10 by using the operation unit 100. By pressing an operation button provided in the operation unit 100, the user can instruct to perform synchronous control such as causing the air-conditioning device 90 in a certain region of the room to operate simultaneously with turning on lighting fixtures 10 located near the air-conditioning device 90. The operation button herein can be implemented with a hardware key, or can be implemented with a software key on a screen. With this synchronization performed with respect to the lighting fixtures 10 located nearby, the lighting fixtures 10 located at distant positions (located in another region distant therefrom) are not turned on in conjunction with these lighting fixtures 10 located nearby, which can thus lead to contribution to energy saving as well.

Conventionally, on the wall 3 of the room, an operation unit for operating the air-conditioning device 10 and a switch for operating ON/OFF of the lighting fixtures 10 are separately provided, and cannot be collectively operated. However, with the device control system 1000 as described above, in the unit of a region in which the room is divided, the plurality of lighting fixtures 10 located in the region and one air-conditioning device 90 can be controlled in cooperation. This can provide the user with an operation screen including both of the operation unit and the switch.

While one air-conditioning device 90 and a plurality of lighting fixtures 10 connected to the air-conditioning device 90 are controlled by one operation unit 100 in the example of FIG. 13, other configurations may be alternatively employed. A plurality of air-conditioning devices 90 installed in one region and a plurality of lighting fixtures 10 connected to the plurality of air-conditioning device 90 can be controlled by one operation unit 100. In other words, the operation unit 100 can be provided in the unit of one region, instead of the unit of one air-conditioning device 90. Further, one operation unit 100 that can operate all of the regions in the unit of region can be configured. In a wide room space of an office building, it is not uncommon that a plurality of air-conditioning devices installed in regions are caused to operate by one operation unit.

Figure 14:
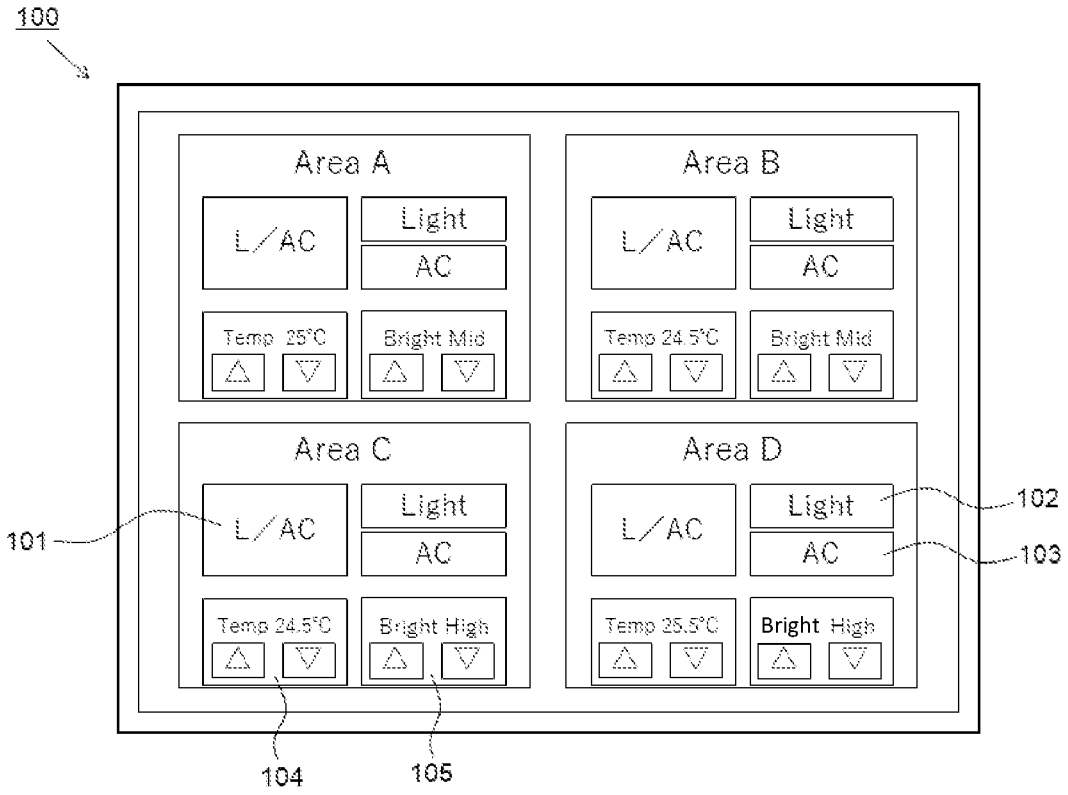
FIG. 14 is a diagram illustrating an example of an operation screen displayed in an operation unit according to the embodiment.

FIG. 14 is an example of an operation screen for operating the plurality of lighting fixtures 10 and the plurality of air-conditioning devices 90 installed in the room for each region by using a single operation unit 100. In this manner, region names for each of the regions, such as "area A" and "area B", are displayed, and for each of the regions, a collective operation button 101 for collectively operating ON/OFF of lighting and air-conditioning, a lighting operation button 102 for collectively operating ON/OFF of only lighting, and an air-conditioning operation button 103 for collectively operating ON/OFF of only air-conditioning are provided. For these operation buttons, letters or symbols such as icons are displayed, which allow the user to intuitively recognize whether lighting and air-conditioning are to be collectively operated or are to be individually operated. Further, a temperature adjustment button 104 for adjusting set temperature of air-conditioning is provided, or in a case in which lighting has the lighting control function, a brightness adjustment button 105 for adjusting intensity of lighting or the like is further provided. In a case in which the operation unit 100 displays the operation screen as described above, a switch for lighting and a controller for air-conditioning need not be separately attached to the wall 3, and thus operability for the user is also enhanced.

Second Embodiment

Figure 15:
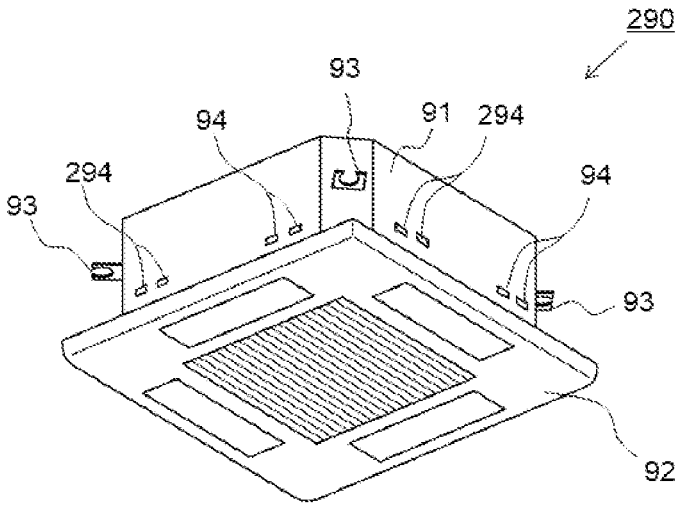
FIG. 15 is a perspective view of an air-conditioning device according to a second embodiment.
Figure 16:
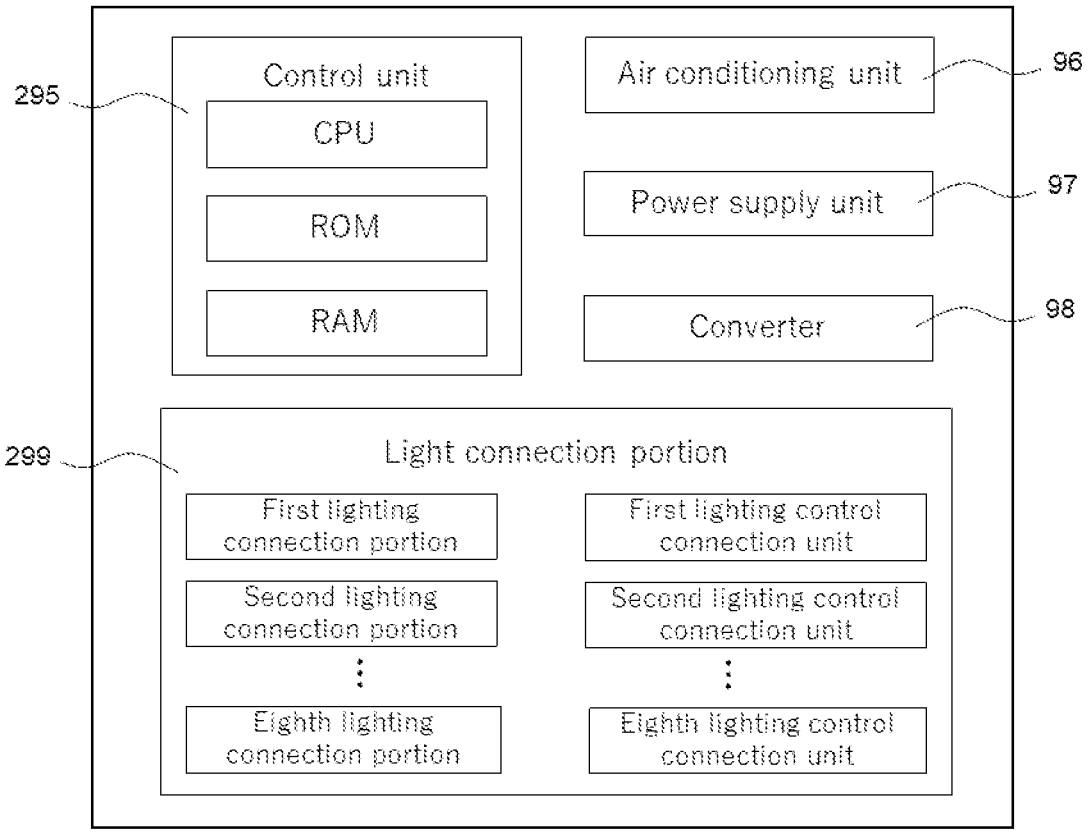
FIG. 16 is a block diagram for describing a hardware configuration of the air-conditioning device according to the second embodiment.
Figure 17:
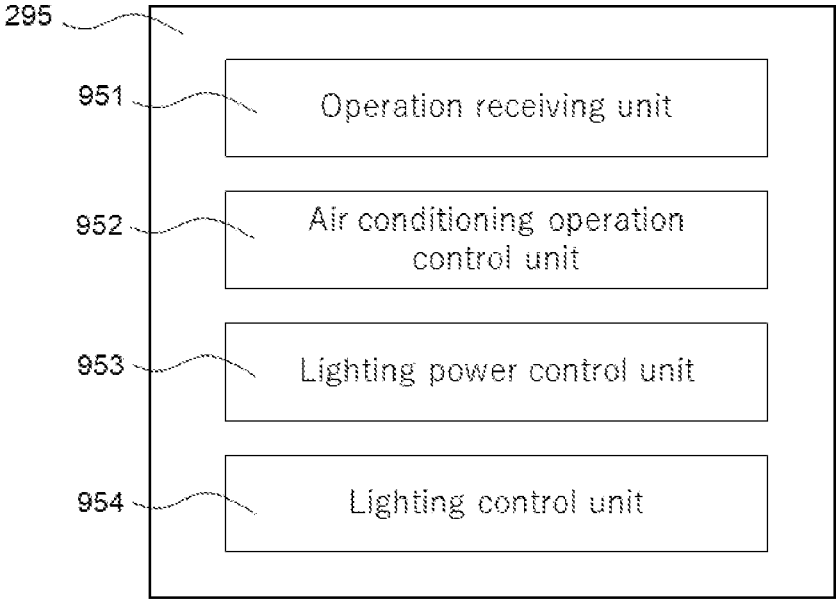
FIG. 17 is a block diagram for describing a software configuration of the air-conditioning device according to the second embodiment.

Next, an air-conditioning device 290 in a building according to the second embodiment will be described. FIG. 15 is a perspective view of the air-conditioning device 290. Further, FIG. 16 is a block diagram for describing a hardware configuration of the air-conditioning device 290.

The air-conditioning device 290 according to the second embodiment is the same as that of the first embodiment in that the air-conditioning device 290 includes, as the connector receiving portion, a first connector receiving portion 94 provided for supply of the power voltage to the lighting fixture 10, and is yet different from that of the first embodiment in that the air-conditioning device 290 includes a second connector receiving portion 294 provided for lighting control of the lighting fixtures 10. Note that, a wiring that enables electric conduction and communication can be connected to one connector receiving portion such that supply of power and lighting control can be performed. In other words, the implementation can be achieved with the connector receiving portion that collectively includes the first connector receiving portion 94 and the second connector receiving portion 294. Alternatively, the connector receiving portion for lighting control can be provided, and the connector receiving portion for supply of power cannot be provided. In this case, wirings are connected to the lighting fixture 10 so that the lighting fixture 10 can receive supply of power using another route, instead of a route from the air-conditioning device 290.

Further, since the air-conditioning device 290 includes the second connector receiving portion 294, a lighting connection portion 299 is further provided with first to eighth lighting control connection portions for lighting control of each of the lighting fixtures 10, in addition to the first to eighth lighting connection portions for supply of the power voltage to each of the lighting fixtures 10. Further, in a control unit 295, a driver program for controlling lighting control of the lighting fixtures 10 is installed, and a lighting control unit 954 that executes lighting control for the lighting fixtures 10 functions on the basis of the driver program.

In this manner, according to the second embodiment, in the air-conditioning device 290, not only the supply of the power voltage to the lighting fixtures 10 connected to the connector receiving portion but also lighting control can be performed. For example, control can be performed so that the color temperature of lighting is changed between a case in which the air-conditioning device 90 operates in the cooling operation and a case in which the air-conditioning device 90 operates in the heating operation. For example, during the cooling operation, a sense of coolness can be given to the user through their visual sense by adjusting the color temperature so that the lighting has a bluish white color, whereas during the heating operation, a sense of warmth can be given to the user through their visual sense by adjusting the color temperature so that the lighting has an orangish white color.

The building, the method of constructing the building, the method of installing the lighting fixture in the building, and the like have been described according to the present invention, based on each embodiment. However, the technical idea of the present invention is not limited to the specific embodiments described above. In the embodiments, an example have been described in which the lighting fixture according to the present invention is installed in a room. However, the installation place is not limited to a room, and can be, for example, a place such as a main entrance and a hall. The room space is not limited to a room, and can refer to a space that is present on the opposite side of the rear of the ceiling with the ceiling as a boundary.

Further, the present invention can be applied even without satisfaction with the requirements that all of the constituent elements disclosed in each embodiment are necessarily and sufficiently included. With a person skilled in the art or within a range of a degree of freedom of design in the technical field to which the invention pertains, the present invention can be applied even in a case in which a part of the constituent elements disclosed in the embodiments is not described in claims. This specification discloses the invention on the assumption that such is included.

INDUSTRIAL APPLICABILITY

The building described in each embodiment can be used in the construction field for an office building and a high-rise building.

DENOTATIONS OF REFERENCE NUMERALS

1 Building
2 Floor
3 Wall
4 Ceiling
5 Window
10 Lighting fixture
11 Base plate
12 Cover
13 Buffer
14 DC harness
15 Substrate
16 Light source element
17 Light emitting element
18 Wavelength conversion member
19 Sealing member
20, 30 Hanging member
40 Ceiling member
50, 60 Wiring
70 Socket
71 Fastener
80 Structural body
90, 290 Air-conditioning device
91 Casing
92 Ceiling surface panel
93 Fixing portion
94, 294 Connector receiving portion
95 Control unit
951 Operation receiving unit
952 Air-conditioning operation control unit
953 Lighting power control unit
954 Lighting control unit

96 Air-conditioning unit
97 Power supply unit
98 Converter
99, 299 Lighting connection portion
1000 Device control system
100 Operation unit
101 Collective operation button
102 Lighting operation button
103 Air-conditioning operation button
104 Temperature adjustment button
105 Brightness adjustment button
500 Remote server

What is claimed is:

1. A system comprising:

an air-conditioning device to be installed on a ceiling, the air-conditioning device comprising:

a casing that comprises an upper wall and a plurality of lateral walls extending downward from the upper wall, an air-conditioning unit located in the casing, and at least one connector receiving portion located in a laterally outward-facing surface of at least one of the lateral walls of the casing and configured to supply a power voltage, wherein the at least one connector receiving portion is located so as to be above the ceiling when the air-conditioning device is installed on the ceiling;

a plurality of lighting fixtures to be installed on the ceiling; and an operation unit configured to allow a user to perform operation for the air-conditioning device and the lighting fixtures, wherein:

the plurality of lighting fixtures are electrically connected to a wiring connected to the at least one connector receiving portion of the air-conditioning device and receive the power voltage from the air-conditioning device, and the operation unit is configured to provide the user with operation to collectively perform an instruction for the air-conditioning device and the plurality of lighting fixtures configured to receive the power voltage from the air-conditioning device.

2. The system according to claim 1, wherein:

the air-conditioning device further comprises:

a ceiling surface panel including a lower surface forming a ceiling surface and an upper surface connected to the casing, and a control unit comprising:

an air-conditioning operation control unit configured to control supply of a power voltage for causing the air-conditioning unit to operate, and a lighting power control unit configured to control the supply of the power voltage to the plurality of lighting fixtures; and the at least one connector receiving portion comprises four or more connector receiving portions located in laterally outward facing surfaces of the plurality of lateral walls of the casing.

3. The system according to claim 1, wherein:

an illuminance of the plurality of lighting fixtures to which the power voltage is supplied from the air-conditioning device while the air-conditioning device is in cooling mode is more bluish white than an illuminance of the plurality of lighting fixture to which the power voltage is supplied from the air-conditioning device while the air-conditioning device is in a heating mode.

4. The system according to claim 1, wherein:

an illuminance of the plurality of lighting fixtures to which the power voltage is supplied from the air-conditioning device while the air-conditioning device is in heating mode is more orangish white than an illuminance of the plurality of lighting fixture to which the power voltage is supplied from the air-conditioning device while the air-conditioning device is in a cooling mode.

5. The system according to claim 1, wherein:

an illuminance of the four or more of the lighting fixtures to which the power voltage is supplied from the respective air-conditioning device while the air-conditioning device is in cooling mode is more bluish white than an illuminance of the four or more of the lighting fixture to which the power voltage is supplied from the respective air-conditioning device while the air-conditioning device is in a heating mode.

6. The system according to claim 1, wherein:

an illuminance of the four or more of the lighting fixtures to which the power voltage is supplied from the respective air-conditioning device while the air-conditioning device is in heating mode is more orangish white than an illuminance of the four or more of the lighting fixture to which the power voltage is supplied from the respective air-conditioning device while the air-conditioning device is in a cooling mode.

7. The system according to claim 1, wherein:

the at least one connector receiving portion comprises first and second connector receiving portions located in a laterally outward-facing surface of a first of the lateral walls of the casing, and third and fourth connector receiving portions located in a laterally-outward-facing surface of a second of the lateral walls of the casing.

8. A system comprising:

a plurality of lighting fixtures to be installed on a ceiling; and

A plurality of air-conditioning devices to be installed on the ceiling, each air-conditioning device comprising:

a casing that comprises an upper wall and a plurality of lateral walls extending downward from the upper wall, an air-conditioning unit located in the casing, at least one connector receiving portion located in a laterally outward-facing surface of at least one of the lateral walls of the casing and configured to supply a power voltage, wherein the at least one connector receiving portion is located so as to be above the ceiling when the air-conditioning device is installed on the ceiling; and a control unit configured to control the supply of the power voltage to four or more of the lighting fixtures each electricality connected to a wiring connected to the at least one connector receiving portion of the air-conditioning device.

9. The system according to claim 8, wherein:

each of the plurality of air-conditioning devices further comprises:

a ceiling surface panel including a lower surface forming a ceiling surface and an upper surface connected to the casing;

the control unit comprises:

an air-conditioning operation control unit configured to control supply of a power voltage for causing the air-conditioning unit to operate, and a lighting power control unit configured to control the supply of the power voltage to the respective four or more of the lighting fixtures; and the at least one connector receiving portion comprises four or more connector receiving portions located in laterally outward facing surfaces of the plurality of lateral walls of the casing.

10. The system according to claim 8, wherein:

the at least one connector receiving portion comprises first and second connector receiving portions located in a laterally outward-facing surface of a first of the lateral walls of the casing, and third and fourth connector receiving portions located in a laterally-outward-facing surface of a second of the lateral walls of the casing.

* * * * *